US006883470B2

(12) United States Patent
Lee

(10) Patent No.: US 6,883,470 B2
(45) Date of Patent: Apr. 26, 2005

(54) ENGINE COOLING SYSTEM

(75) Inventor: Bong-Sang Lee, Suwon (KR)

(73) Assignee: Hyundai Motor Company, Seoul (KR)

( * ) Notice: Subject to any disclaimer, the term of this patent is extended or adjusted under 35 U.S.C. 154(b) by 131 days.

(21) Appl. No.: 10/235,604

(22) Filed: Sep. 4, 2002

(65) Prior Publication Data

US 2003/0047150 A1 Mar. 13, 2003

(30) Foreign Application Priority Data

Sep. 11, 2001 (KR) ..... 2001-055877

(51) Int. Cl.[7] ..... F01P 7/14
(52) U.S. Cl. ..... 123/41.1; 123/41.31
(58) Field of Search ..... 123/41.1, 41.29, 123/41.31

(56) References Cited

U.S. PATENT DOCUMENTS 6,125,811 A * 10/2000 Koriyama et al. ..... 123/195 R

FOREIGN PATENT DOCUMENTS

JP 03-202616 4/1991

* cited by examiner

*Primary Examiner*—Noah P. Kamen
(74) *Attorney, Agent, or Firm*—Morgan Lewis & Bockius LLP

(57) ABSTRACT

An engine cooling system is provided that includes an engine, a radiator, and a coolant pump. A thermostat is disposed in a chamber formed in a coolant passageway connecting the radiator and the coolant pump. The thermostat selectively opens and closes the coolant passageway in response to the temperature of coolant flow from a throttle body disposed in another coolant passageway connecting the outlet portion of the engine body and the coolant pump. Preferably, the thermostat is actuated depending only on the temperature of coolant passing through the throttle body.

6 Claims, 2 Drawing Sheets

ENGINE COOLING SYSTEM

FIELD OF THE INVENTION

The present invention relates to an engine cooling system in which a thermostat is actuated by the temperature of coolant passing through a throttle body, without a coolant bypass line connecting an engine body and the thermostat.

BACKGROUND OF THE INVENTION

Generally, a cooling system for a liquid-cooled engine is provided with an apparatus for controlling coolant temperature in order to reduce engine friction and exhaust emissions. There are two common types of cooling systems. An exit-control cooling system controls coolant circulation using the temperature of coolant exiting an engine body. An entrance-control cooling system controls the temperature of coolant that flows into the engine body.

The exit-control cooling system has a simple structure, but in this system, coolant circulation cannot be precisely controlled. Recently, the entrance-control cooling system has been widely used for precise control of coolant circulation.

A conventional entrance-control cooling system typically includes a coolant bypass passageway, one end of which is connected to the engine body and the other to the thermostat. The bypass passageway provides coolant that has absorbed heat from the engine body to the thermostat. The main valve of the thermostat is thus opened or closed according to the temperature of the coolant provided through the coolant bypass passageway.

However, in such an entrance-control cooling system, an extra bypass valve and the coolant bypass passageway make the structure of the cooling system complicated. Furthermore, because some portion of the heated coolant in the engine body is bypassed through the coolant bypass passageway, the heating capacity of an associated heater can be decreased.

SUMMARY OF THE INVENTION

The present invention provides an engine cooling system preferably capable of precisely controlling coolant circulation without a coolant bypass passageway from an engine body to a thermostat. In a preferred embodiment an engine body includes a first coolant passageway passing therethrough. A radiator disapates engine heat that is absorbed by the coolant. A coolant pump is disposed in an inlet portion of the first coolant passageway. The coolant pump forces coolant to circulate through the cooling system. A thermostat disposed in a chamber formed in a second coolant passageway connects the radiator and the coolant pump. The thermostat selectively opens and closes the second coolant passageway. A throttle body is disposed in a third coolant passageway connecting the outlet portion of the engine body and the coolant pump. The third coolant passageway is connected to the chamber of the second coolant passageway such that the thermostat is actuated depending only on a temperature of coolant passing through the throttle body.

It is preferable that the engine cooling system further comprises a heater disposed in a fourth coolant passageway connecting the outlet portion of the first coolant passageway and the coolant pump.

BRIEF DESCRIPTION OF THE DRAWINGS

The accompanying drawings, which are incorporated in and constitute a part of the specification, illustrate an embodiment of the invention, and, together with the description, serve to explain the principles of the invention, where.

DETAILED DESCRIPTION OF THE PREFERRED EMBODIMENTS

Hereinafter, a preferred embodiment of the present invention will be described in detail with reference to the accompanying drawings.

Figure 1:
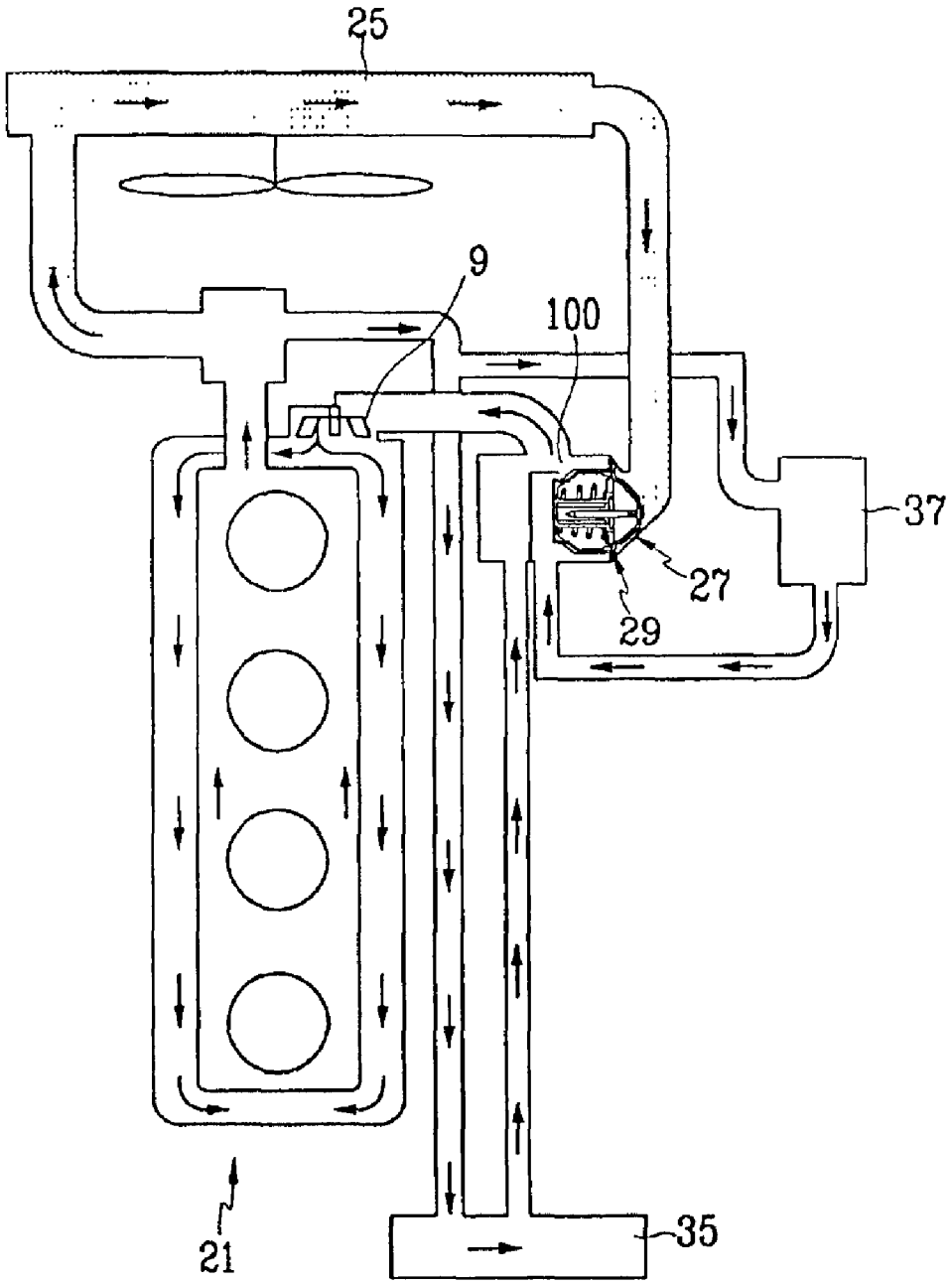
FIG. 1 shows a cooling system according to the preferred embodiment of the present invention.

As shown in FIG. 1, a cooling system according to the preferred embodiment of the present invention includes a coolant pump 9 forcing coolant to circulate through the cooling system.

The coolant pump 9 is disposed between an engine body 21, having a coolant passageway through a cylinder block and a cylinder head, and a radiator 25 that irradiates heat of the engine body that has been absorbed by the coolant to atmosphere. A conventional coolant pump and a radiator can be used as selected by a person of ordinary skill in the art.

A thermostat 27 is disposed in a chamber 100 formed in a coolant passageway connecting the radiator 25 and the coolant pump 9. The thermostat 27 includes a valve 29 that opens and closes the coolant passageway connecting the radiator 25 and the coolant pump 9, depending on coolant temperature. Valve 29 preferably includes a pellet 31 that is filled with a material such as wax that is expandable/contactable depending on temperature, and a biasing member 33. The pellet is positioned where it will be impinged upon by flow of coolant from the throttle body.

A portion of coolant passing through the engine body 21 flows through a coolant passageway connecting the engine body 21 and a throttle body 37. The coolant passing through the throttle body 37 then arrives at the chamber 100.

If the temperature of the coolant supplied from the throttle body 37 is low, the force of the pellet 31 cannot surpass the force of the biasing member 33 so that the valve closes the coolant passageway connecting the radiator 25 and the coolant pump 9. If the temperature of the coolant supplied from the throttle body 37 is high, the force of the pellet 31 can surpass the force of the biasing member 33 so that the valve opens the coolant passageway connecting the radiator 25 and the coolant pump 9.

A heater 35 is provided in a coolant passageway connecting an outlet portion of the engine body 21 and the coolant pump 9, separate from the coolant passageway connecting the outlet portion of the engine body 21 and the coolant pump 9 past the thermostat 27. Therefore, the coolant passing through the heater 35 has no affect on the operation of the thermostat 27.

Operation of the cooling system according to the preferred embodiment of the present invention will now be explained.

Figure 2:
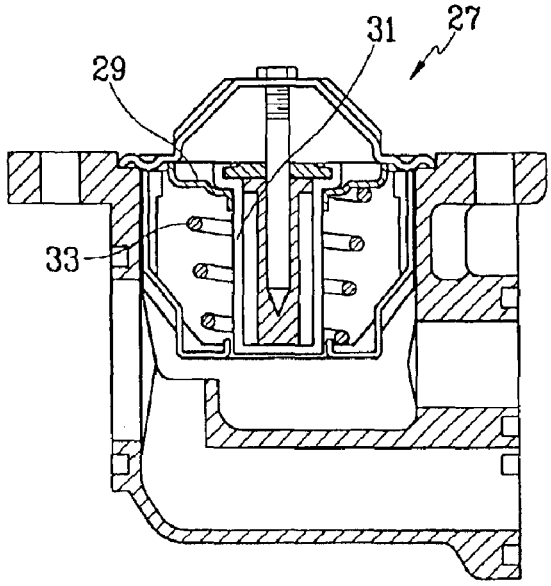
FIG. 2 shows an open state of a thermostat of the cooling system of FIG. 1.

During engine-warming, the temperature of the coolant that passes through the throttle body 37 is low, and as shown in FIG. 2, the expanding force of the pellet 31 is smaller than the force of the biasing member 33 so that the valve 29 maintains a closed state. Therefore, the coolant does not circulate through the radiator 25, and just circulates through the heater 35 and the throttle body 37.

Figure 3:
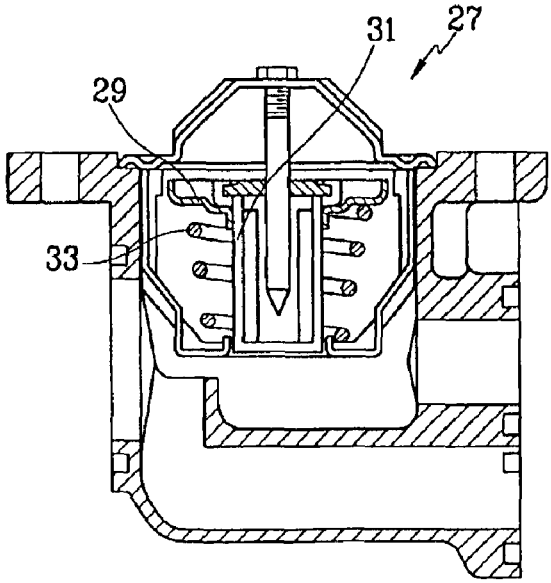
FIG. 3 shows a closed state of the thermostat of the cooling system of FIG. 1.

As the temperature of the coolant passing through the throttle body 37 and to the thermostat 27 increases, the expanding force of the pellet 31 surpasses the force of the biasing member 33 so that the valve opens (FIG. 3). Therefore, the coolant pumped by the coolant pump 9 circulates through the engine body 21, the radiator 25, the throttle body 37, and the heater 35.

Because a temperature drop of the coolant while passing through the throttle body 37 is relatively small, precise coolant circulation control according to the temperature of the coolant passing through the throttle body is possible.

The cooling system according to the present invention controls the thermostat using the coolant that has passed through the throttle body without the need for an extra coolant bypass passageway. Therefore, the structure of the cooling system becomes simpler and the heating capacity of the heater increases. However, persons skilled in the art will recognize that additional passageways may be added or deleted for specific system designs without departing from the teachings of the invention.

Although preferred embodiment of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An engine cooling system, comprising:

an engine body including a coolant passageway;

a coolant pump disposed in an inlet portion of said coolant passageway of said engine body;

a radiator dissipating heat of said engine body that is absorbed by coolant to atmosphere;

a thermostat disposed between said radiator and said coolant pump, said thermostat regulating coolant circulation from said radiator to said coolant pump;

a heater disposed between an outlet portion of said coolant passageway of said engine body and said coolant pump such that temperature of the coolant passing through said heater does not affect operation of said thermostat; and a throttle body disposed between an outlet portion of said coolant passageway of said engine body and said thermostat such that said coolant circulates from said engine body to said coolant pump by way of said throttle body and said thermostat, wherein said thermostat is responsive only to coolant circulating from said throttle body when said thermostat is in a closed position and at least partially responsive to coolant circulating from both said radiator and said throttle body when said thermostat is at least partially open.

2. The engine cooling system of claim 1, wherein said thermostat includes a temperature responsive element positioned to be impinged upon by coolant flow from said throttle body.

3. An engine cooling system of claim 2, wherein said temperature responsive element comprises a material having a resistance to deformation that changes with temperature.

4. The engine cooling system of claim 3, wherein said temperature responsive element comprises a wax filled pellet.

5. An engine cooling system, comprising:

an engine body including a first coolant passageway passing through said engine body;

a radiator dissipating heat of said engine body that is absorbed by coolant to atmosphere;

a coolant pump disposed in an inlet portion of said first coolant passageway, said coolant pump forcing coolant to circulate through said cooling system;

a thermostat disposed in a chamber formed in a second coolant passageway connecting said radiator and said coolant pump, said thermostat selectively opening and closing said second coolant passageway; and a throttle body disposed in a third coolant passageway connecting said outlet portion of said engine body and said coolant pump, said third coolant passageway being connected to said chamber of said second coolant passageway such that said thermostat is actuated depending at least partially upon temperature of coolant passing through said throttle body.

6. The engine cooling system of claim 5, further comprising a heater disposed in a fourth coolant passageway connecting said outlet portion of said first coolant passageway and said coolant pump.

* * * * *